US006014153A

United States Patent [19]

Harvey

[11] Patent Number: 6,014,153

[45] Date of Patent: Jan. 11, 2000

[54] PULSED DROPLET DEPOSITION APPARATUS

[75] Inventor: Robert Alan Harvey, Cambridge, United Kingdom

[73] Assignee: Xaar Technology Limited, Cambridge, United Kingdom

[21] Appl. No.: 09/012,906

[22] Filed: Jan. 23, 1998

Related U.S. Application Data

[63] Continuation of application No. PCT/GB96/01789, Jul. 25, 1996.

[30] Foreign Application Priority Data

Jul. 26, 1995 [GB] United Kingdom ..... 9515337

[51] Int. Cl.[7] ..... B41J 2/045; B41J 2/175

[52] U.S. Cl. ..... 347/71; 347/43; 347/85

[58] Field of Search ..... 347/40, 43, 69, 347/71, 85, 94

[56] References Cited

U.S. PATENT DOCUMENTS 5,402,162 3/1995 Fusting et al. ..... 347/43

FOREIGN PATENT DOCUMENTS 322228 6/1989 European Pat. Off. .
59-103761 6/1984 Japan .
WO 94/27827 12/1994 WIPO .

*Primary Examiner*—Joan Pendegrass
*Attorney, Agent, or Firm*—Marshall, O'Toole, Gerstein, Murray & Borun

[57] ABSTRACT

An inkjet printhead has ink channels separated one from the next by channels walls that are displaceable in response to actuating signals. Groups of adjacent channels are supplied by respective manifolds such that a single displaceable wall bounds channels belonging to adjacent channel groups. A simplification of the construction and manufacture of the printhead results.

47 Claims, 9 Drawing Sheets

SECTION A-A

SECTION A-A

SECTION B-B

SECTION C-C

PULSED DROPLET DEPOSITION APPARATUS

CROSS-REFERENCE TO RELATED APPLICATION

This is a continuation of International Application No. PCT/GB/96/01789 filed Jul. 25, 1996.

TECHNICAL FIELD OF THE INVENTION

The present invention relates to pulsed droplet deposition apparatus, in particular to ink jet printers, comprising a plurality of droplet liquid channels and nozzles in communication with the channels for ejection of droplets of liquid from the channels, adjacent channels being separated by a channel wall displaceable relative to said adjacent channels in response to actuating signals (hereinafter referred to as "apparatus of the kind referred to above").

BACKGROUND ART

Pulsed droplet deposition apparatus of kind referred to above is known in the art in many different forms and configurations:

EP-A-0 278 590 discloses arrangements comprising a plurality of droplet liquid channels and nozzles for ejection of droplets of liquid, wherein ejection of droplets is achieved by displacement of channel-separating walls in response to actuating signals. This document outlines several alternative methods of displacing the channel walls, including the use of piezoelectric material in shear mode, in direct mode and in bimorph configuration.

U.S. Pat. No. 5,277,813 discloses another type of pulsed droplet deposition apparatus of kind referred to above which utilises piezoelectric material subject to an electric field in the depthwise direction and displaceable in shear mode relative to the channel.

EP-A-0 611 654 discloses pulsed droplet deposition apparatus of the kind referred to above and which employs electrostatic attraction forces to displace the channel walls.

In such known apparatus, it is desirable for the active, ink ejecting channels at either end of an array of adjacent active, ink ejecting channels to operate in the same fashion as the other channels in the array, namely for both walls either side of a channel to displace (generally, but not always, in opposite senses) when drawing in or ejecting ink. To this end it has been necessary for the array of active channels to bounded at each side by one or more "guard" channels which, whilst they do not eject ink, nevertheless permit the outermost wall of each outermost active channel of the array to be displaced.

Furthermore, it is known in the art that pulsed droplet deposition apparatus of the kind referred to above should be used for the simultaneous printing of more than one colour: WO95/07185 discloses the construction of an ink jet printer having a number of sub-heads each supplied with a different coloured ink via a separate ink manifold. It is disclosed that the sub-heads may be mounted parallel to one another and offset—either across or in the direction of motion of the printhead—or may be mounted with the respective array directions collinear. The document goes on to state that the sub-heads may be separate components or may be formed in a single coextensive ceramic wafer.

It is an objective of the present invention to simplify both the construction and the manufacturing process of apparatus comprising a plurality of sub heads of the kind referred to above, each sub head being supplied from a separate manifold chamber.

SUMMARY OF THE INVENTION

The present invention consists in one aspect of pulsed droplet deposition apparatus comprising a plurality of droplet liquid channels, nozzles in communication with the channels for ejection of droplets of liquid from the channels, adjacent channels being separated by a channel wall displaceable relative to said adjacent channels in response to actuating signals, a first manifold chamber from which droplet liquid is supplied to a first group of adjacent droplet liquid channels and a second manifold chamber from which droplet liquid is supplied to a second group of adjacent droplet liquid channels, wherein a single displaceable channel wall bounds both a channel belonging to said first group and a channel belonging to said second group.

The adoption of such an arrangement dispenses with the need for guard channels at either end of each sub-head (with the exception of the guard channels at those ends of those sub heads located at the two extremities of the array). This reduction in the number of channels to be manufactured impacts both on the manufacturing time and also the amount of material required to make a printhead. The apparatus, having fewer channels, is also less wide than a design incorporating a number of conventional sub-heads. Finally, in the case of apparatus of the kind referred to above that is actuated by means of electrodes located in the channels themselves (see, for example, that disclosed in FIGS. 2*a*, 2*b* of the aforementioned EP-A-0 278 590) and in which the guard channels also require electrodes and a driver circuit, there are clearly savings to be made in the drive electronics and the associated electrical connections to the channels.

Further embodiments of the present invention are set out in the following examples and in the claims.

The invention will now be described by way of example by reference to the following diagrams, of which:

Figure 3:
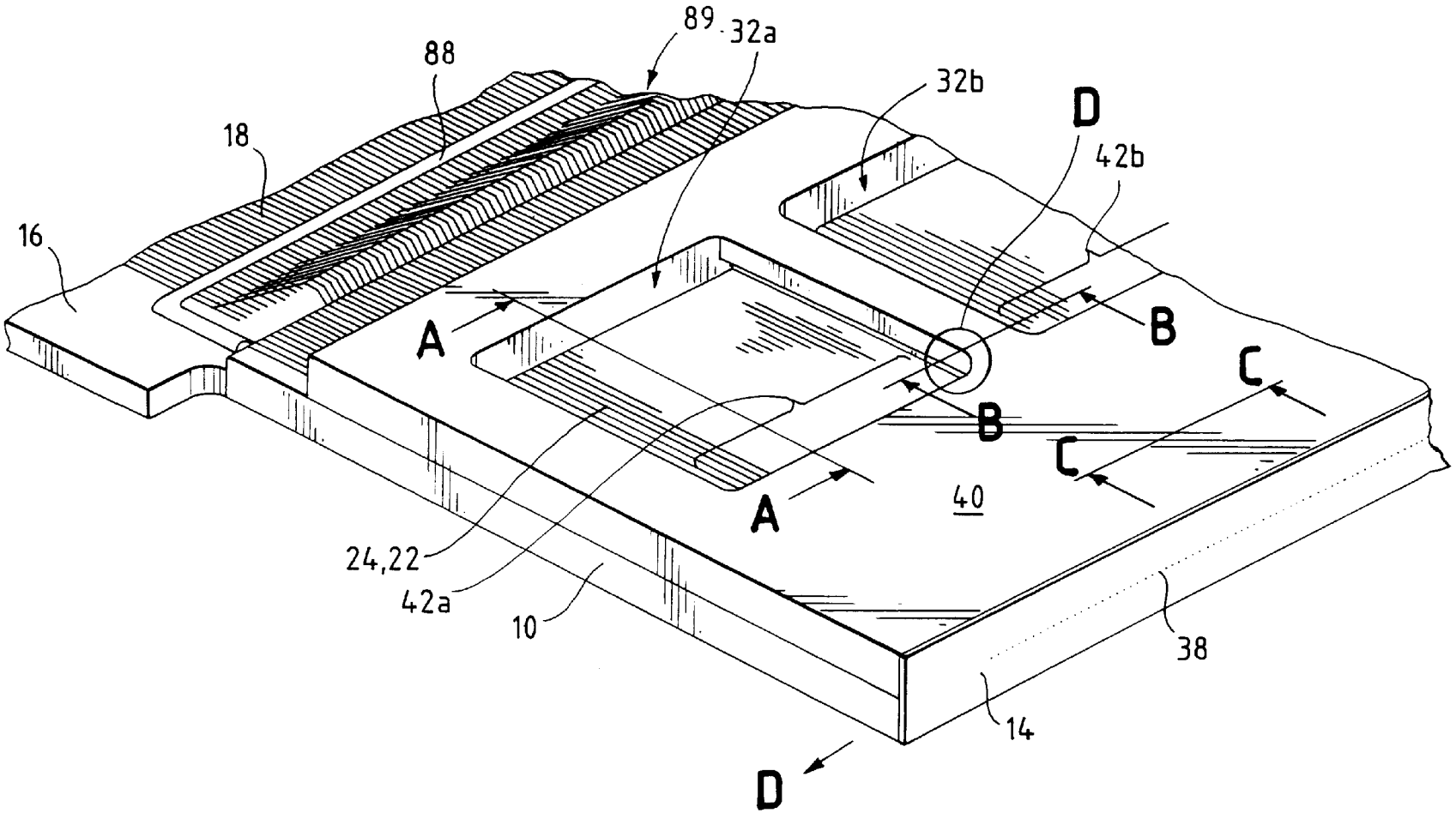
FIG. 3 is a perspective view of pulsed droplet deposition apparatus according to the invention.
Figure 4A:
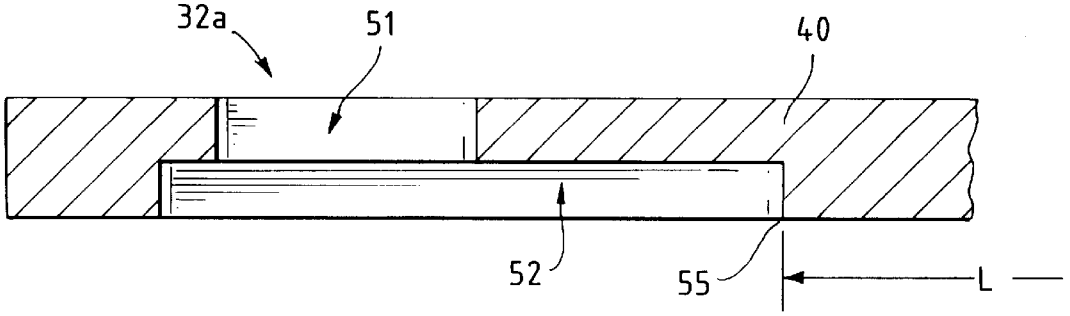
Figure 4B:
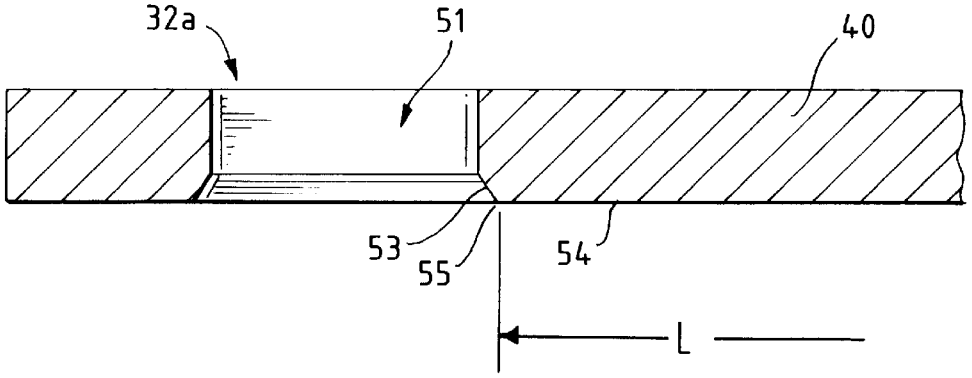
Figure 5A:
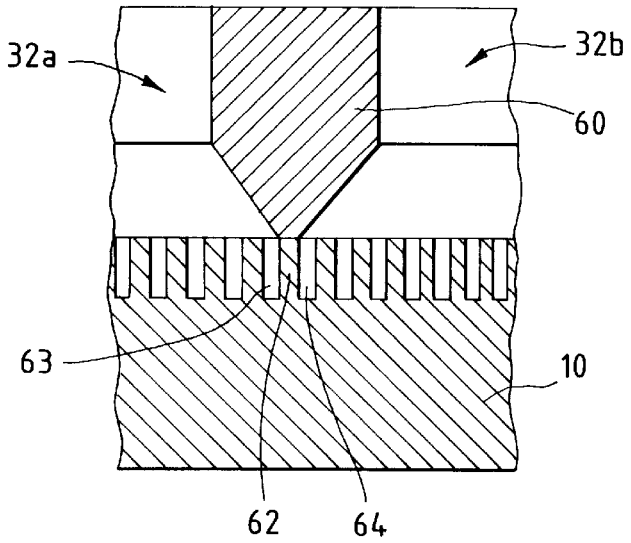
Figure 5B:
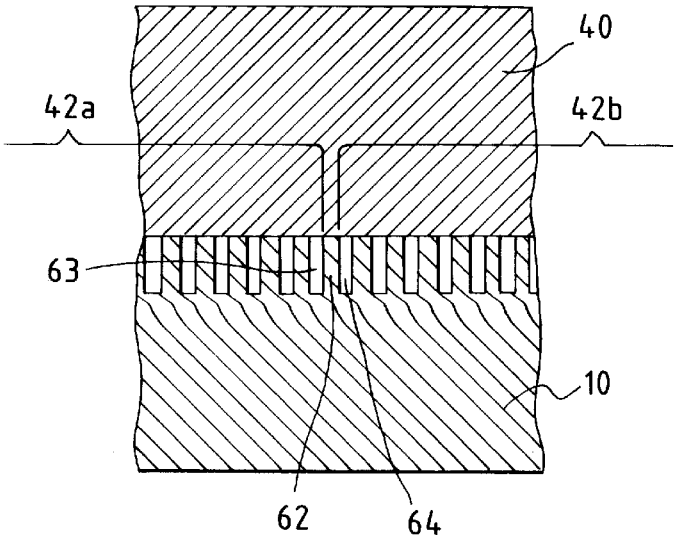
Figure 6:
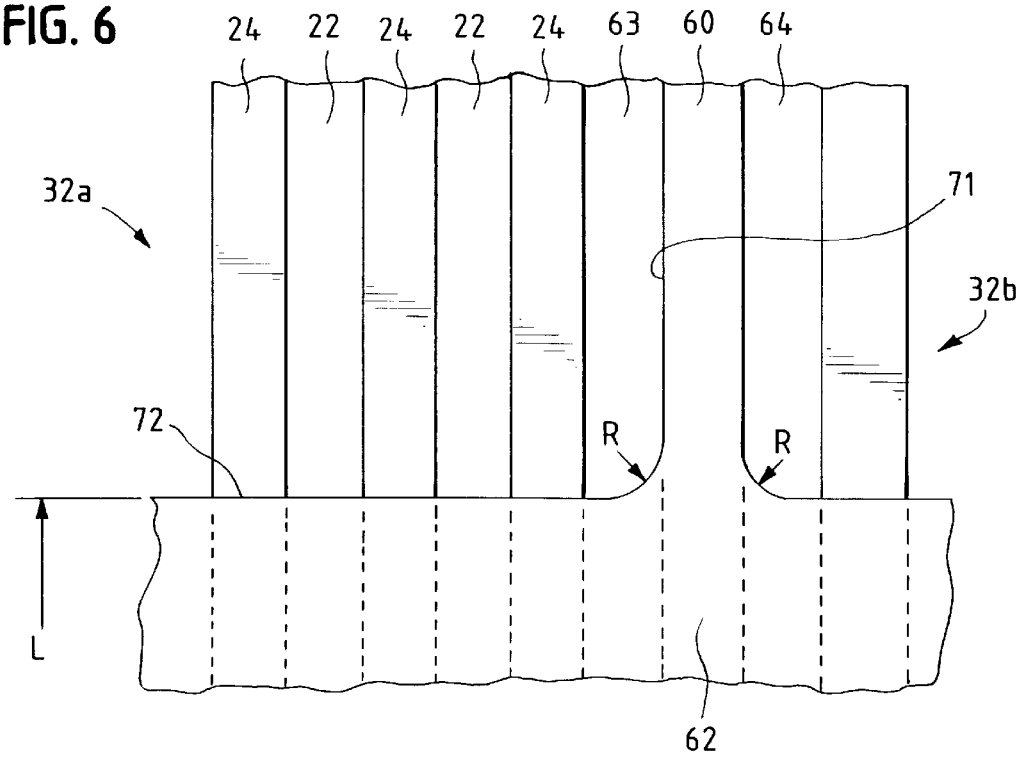
Figure 7A:
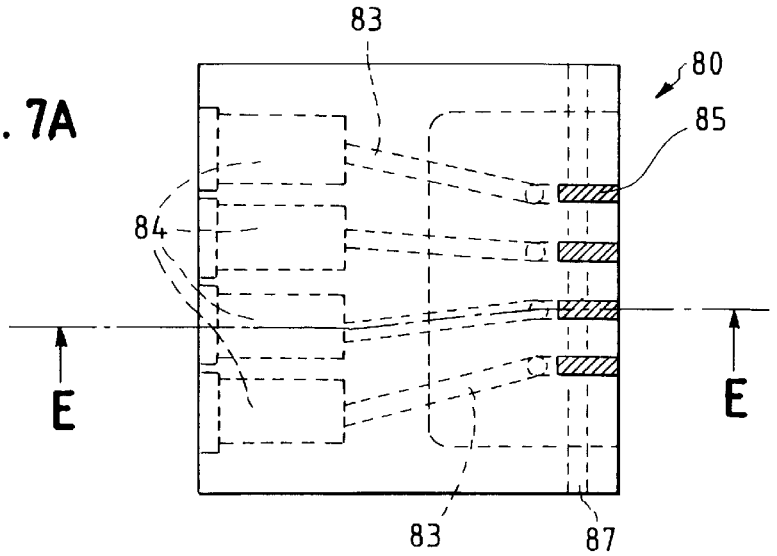
Figure 7B:
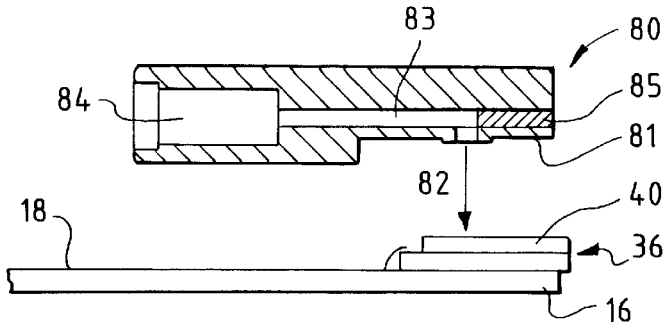

FIGS. 4*a* and 4*b* are alternative embodiments of the cover when seen in section AA in FIG. 3;

FIGS. 5*a* and 5*b* are sections through the cover when seen in sections BB and CC in FIG. 3 respectively;

FIG. 6 corresponds to detail "D" as shown in FIG. 3, as seen in the bonding plane between the cover 40 and the tops of the channel walls 24;

FIG. 7*a* is a plan view of a manifold block suitable for use in a particular embodiment of the invention;

FIG. 7*b* is a section on the line EE of FIG. 7*a;*

Figure 8:
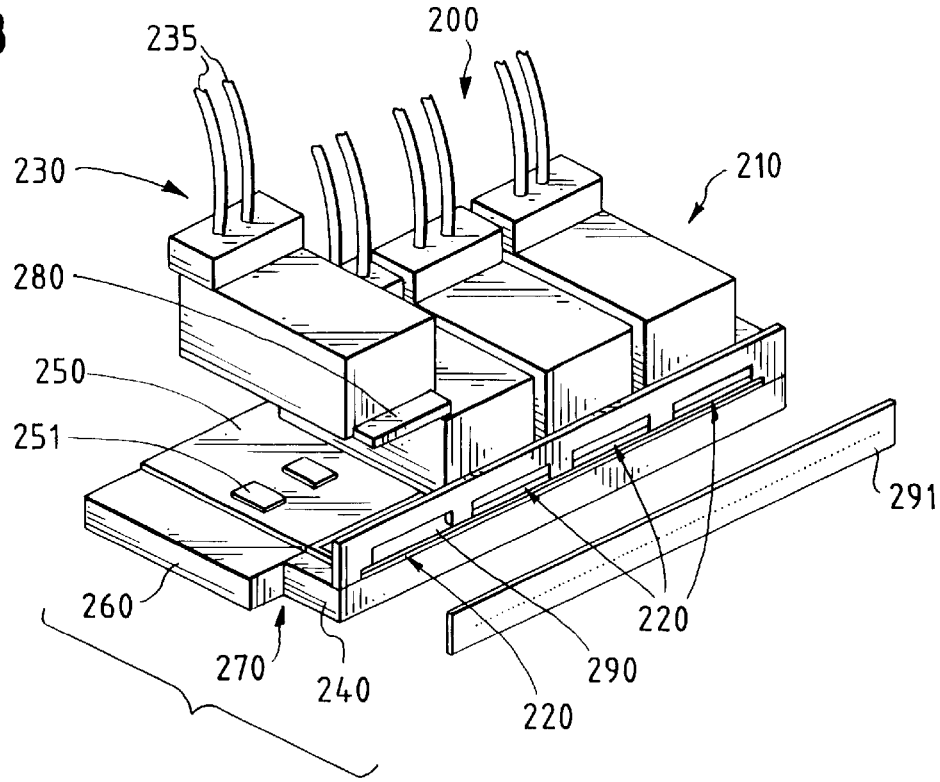
Figure 9:
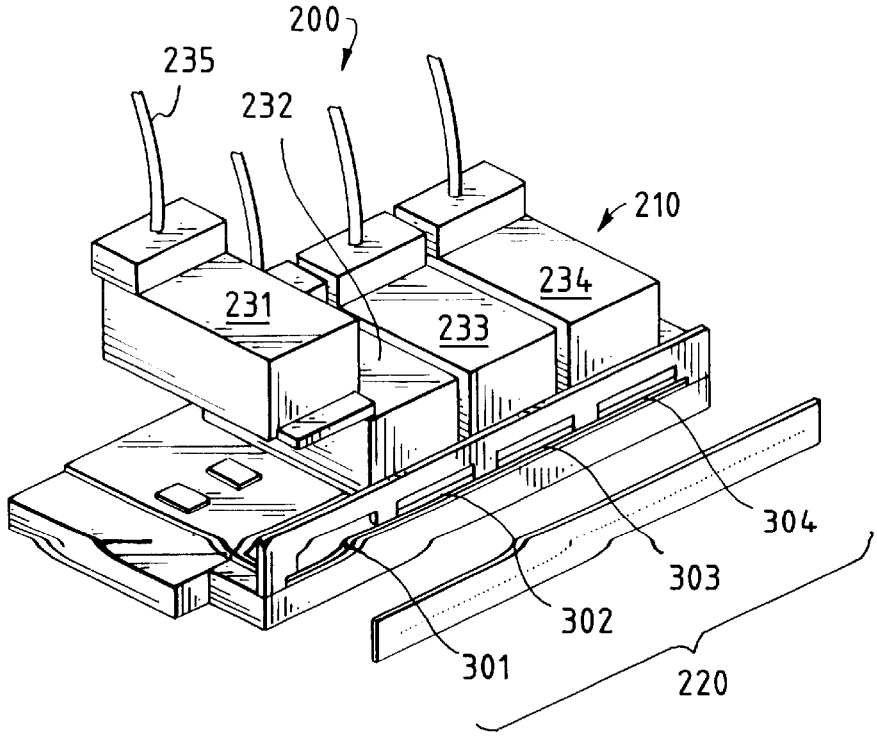
Figure 10A:
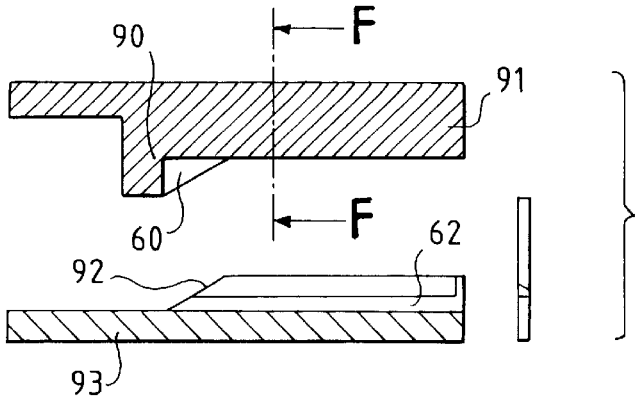
Figure 10B:
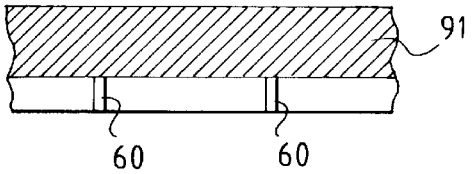

FIGS. 8 and 9 show perspective views of two further embodiments of the invention;

FIG. 10*a* is an exploded sectional view (taken in a plane lying parallel to the channel walls) of a first alternative type of printhead incorporating the present invention;

FIG. 10*b* is a view along line FF of FIG. 10*a;*

Figure 11A:
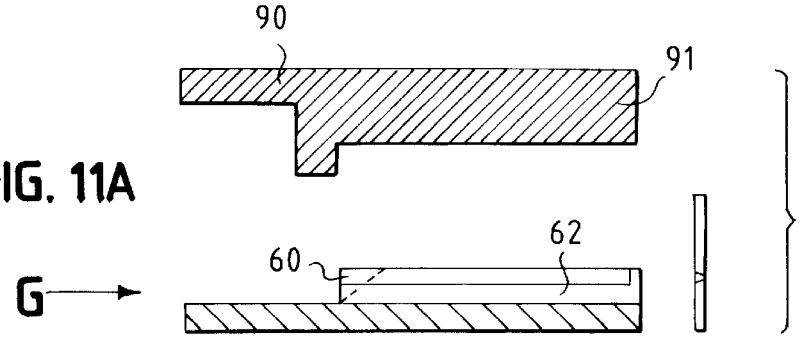
Figure 11B:
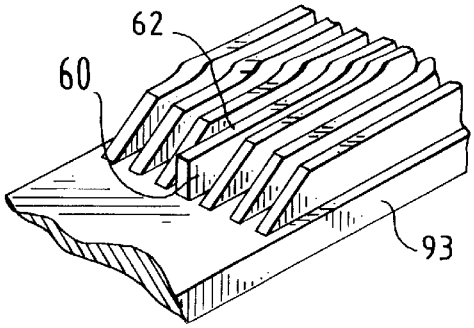

FIG. 11*a* is an exploded sectional view (taken in a plane lying parallel to the channel walls) of a second alternative type of printhead incorporating the present invention;

FIG. 11*b* is a view in direction G of FIG. 11*a;*

Figure 12A:
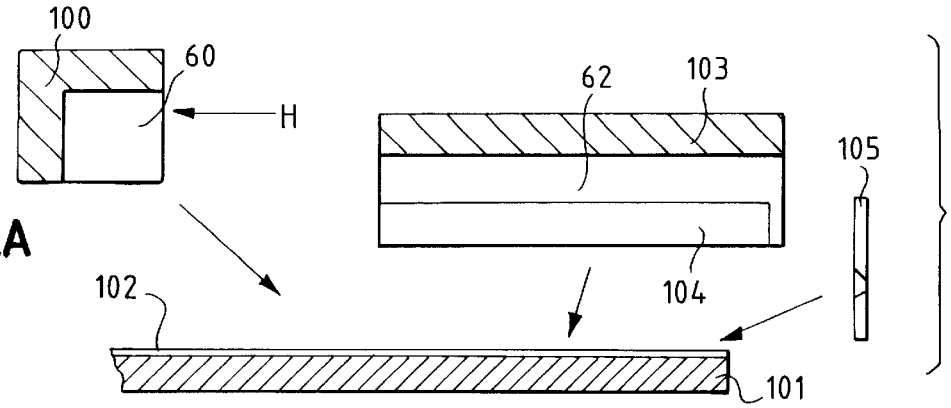
Figure 12B:
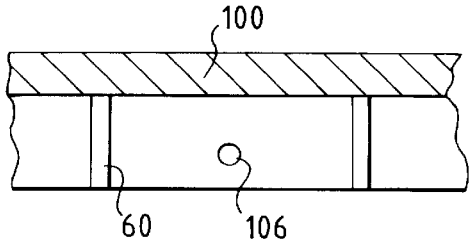

FIG. 12*a* is an exploded sectional view (taken in a plane lying parallel to the channel walls) of a third alternative type of printhead incorporating the present invention;

FIG. 12*b* is a view in direction H of the manifold structure shown in FIG. 12*a;*

Figure 13A:
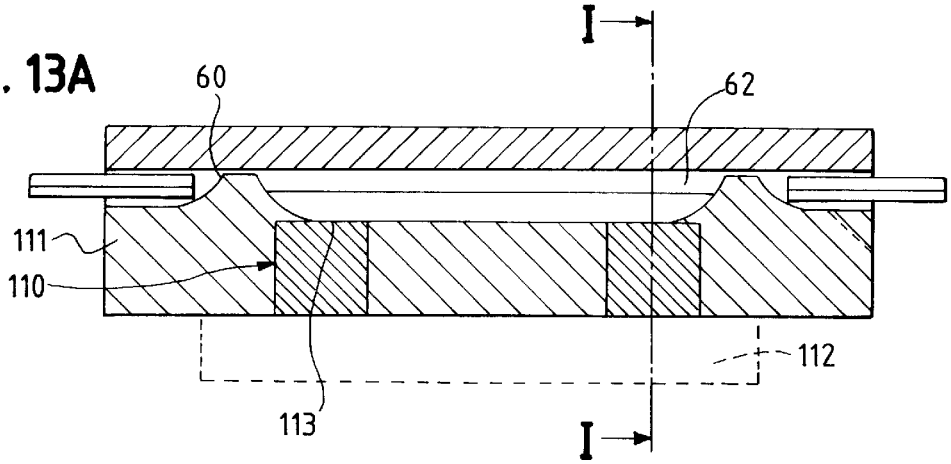
Figure 13B:
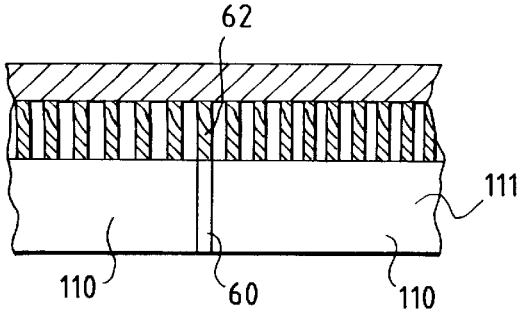

FIG. 13*a* is a sectional view (again taken in a plane lying parallel to the channel walls) of a fourth alternative type of printhead incorporating the present invention; and FIG. 13*b* is a view along section line I—I in FIG. 13*a*.

Figure 1:
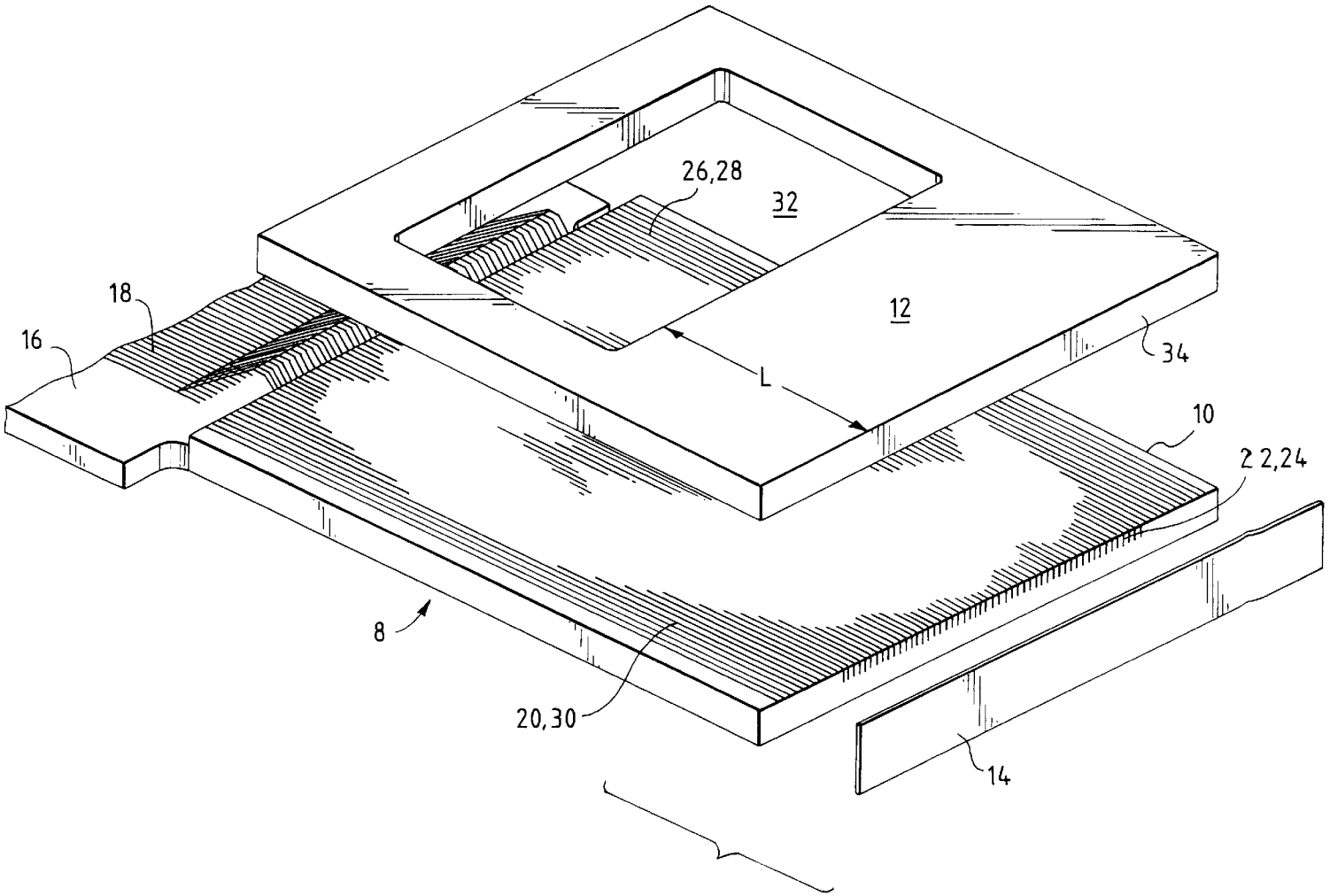
FIG. 1 PRIOR ART
FIG. 1 shows an exploded view in perspective of the components comprising a conventional single serial ink jet sub-head, including a printhead base into which parallel grooves are formed, a circuit board with connection tracks, a cover component and a nozzle plate.

FIG. 1 shows an exploded view of a conventional ink jet sub-head 8 incorporating piezo-electric wall actuators operating in shear mode, as is known, for example, from the above-mentioned EP-A-0 278 590 and also from EP-A-0 364 136. The sub-head comprises a base component 10 of piezo-electric material poled in the thickness direction, a cover component 12 and a nozzle plate 14. A circuit board is also illustrated which has connection tracks 18 for application of electrical signals for droplet ejection from the printhead.

The base component 10 is formed with a multiplicity of parallel grooves 20 formed in the sheet of piezo-electric material, as described in U.S. Pat. No. 5,016,028. The base component has a forward part in which the grooves are comparatively deep to provide ink channels 22 separated by opposing actuator walls 24. The grooves rearwardly of the forward part are comparatively shallow to provide locations 26 for connection tracks 28. After forming the grooves 20, metallised plating is deposited by vacuum deposition in the forward part at angles so chosen as to cause the plating to extend approximately one half of the channel height from the tops of the walls, so providing electrodes 30 on opposing faces of the ink channels 22. At the same time the electrode metal is deposited in the rearward part of the locations 26 providing connection tracks 28 connected to the electrodes in each channel. The tops of the walls separating the grooves are kept free of plating, either by lapping or as in U.S. Pat. No. 5,185,055 by initially applying a polymer film to the base 10, and removing the metallised plating by causing removal of the film. After application of the metal electrodes 30 the base component 10 is coated with a passivant layer for electrical isolation of the electrodes from ink.

The cover component 12 illustrated in FIG. 1 is formed of a material thermally matched to the base component 10. One solution to this is to employ piezo-ceramic similar to that employed for the base so that when the cover is bonded to the base the stresses induced in the interfacial bond layer are minimised. The cover is cut to a similar width to the base component but shorter, so that after bonding their remains a length of the tracks 28 in the rearward part uncovered for bonded wire connections to the connection tracks 18. A window 32 is formed in the cover which provides a supply manifold for the supply of liquid ink into the channels 22. The forward part of the cover from the window to the forward edge 34 is of length L as indicated in the diagram. This region when bonded to the tops of the walls 24 determines the active channel length, which governs the volume of the ejected ink drops.

Figure 2:
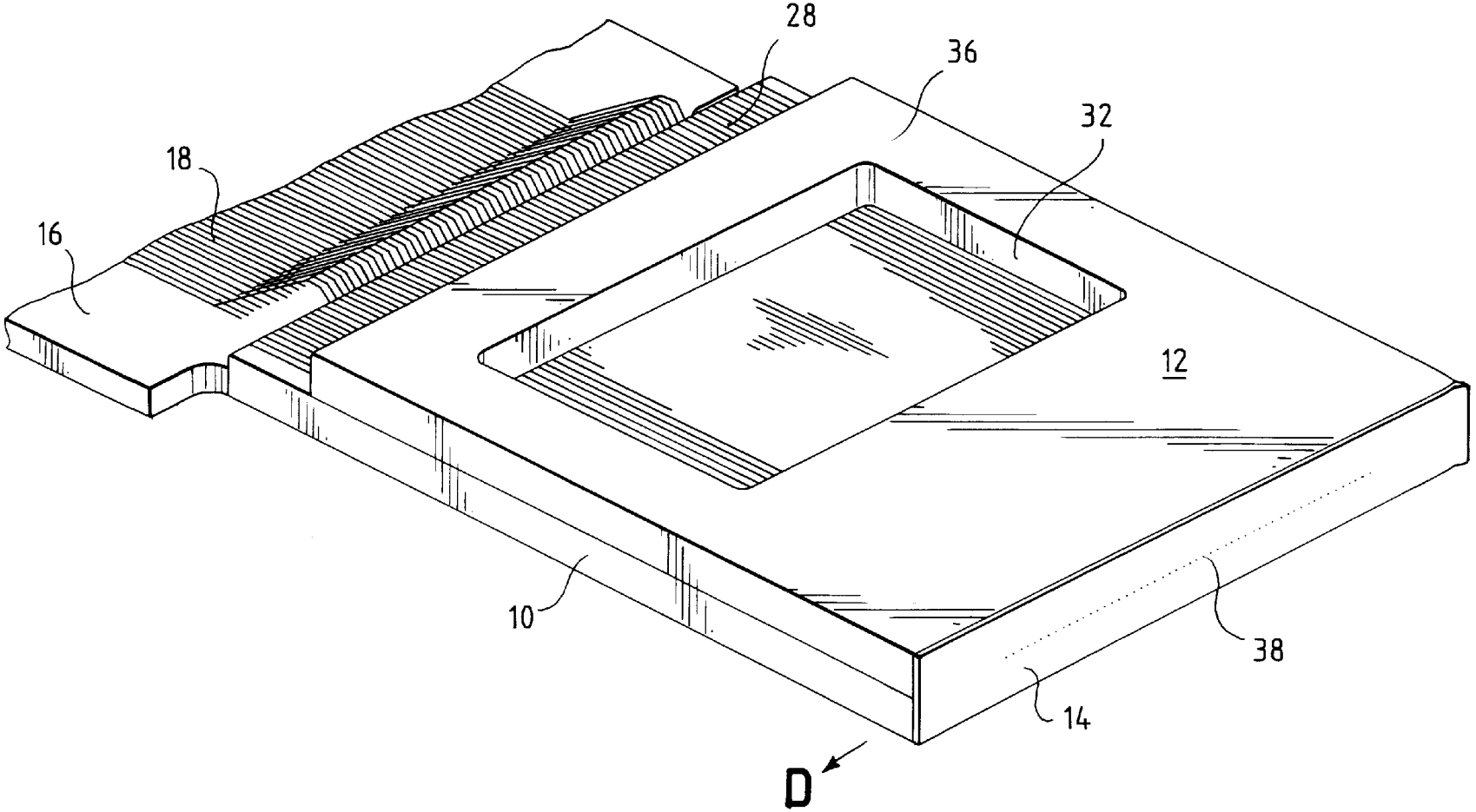
FIG. 2 PRIOR ART
FIG. 2 illustrates the conventional sub-head of FIG. 1 after bonded assembly of the cover, the nozzle plate and the circuit board components to the printhead base.

The base component and cover component are illustrated after bonding in FIG. 2. A method of bonding is disclosed in WO95/04658. Particular care is taken in the machining tolerances of the forward edge of the cover component 12 and its alignment with the corresponding edge of the base component 10 and by the design of the assembly jig to ensure that the front faces of the bonded printhead component 36 are held co-planar for attachment of the nozzle plate 14. The nozzle plate 14 consists of a strip of polymer such as polyimide, for example Ube Industries polyimide UPILEX™ R or S, coated with a non-wetting coating as provided, for example, in U.S. Pat. No. 5,010,356. The nozzle plate is bonded by application of a thin layer of glue, allowing the glue to form an adhesive bond in contact with the front face of the bonded component 36 thereby forming a bonded seal between the nozzle plate 14 and the walls surrounding each channel 22 and then allowing the glue to cure. After application of the nozzle plate, nozzles 38 (FIG. 2) are formed in the nozzle plate connecting to each channel 22 at the nozzle spacing appropriate to the printhead and extending in an array direction "D", as disclosed in WO93/15911.

After assembly of the bonded printhead component 36, the circuit board 16 is bonded thereto so as to provide connection tracks 18, and bonded wire connections are made joining the tracks 18 to corresponding connection tracks 28 in the rearward part of the base component 10.

FIG. 3 illustrates pulsed droplet deposition apparatus according to the present invention. Features identical to those in the embodiments of FIGS. 1 and 2 are designated by the same reference numerals.

With the exception of the actual number of channels, the construction of the base component in this embodiment is essentially the same as that of a base component 10 of an ink jet sub head as described with reference to FIGS. 1 and 2. In particular, the base 10 of the apparatus shown in FIG. 3 has a plurality of droplet liquid channels 22, nozzles 38 in communication with the channels 22 for ejection of droplets of liquid, generally ink, and opposing actuator walls 24, transversely displaceable in shear mode in response to actuating signals that are applied by electrodes.

The cover component 40 of the embodiment of FIG. 3 is also the same as that of a conventional sub-head in so far as it is formed of a material thermally matched to the base component 10, for instance a piezo-electric ceramic similar to that employed for the base, or a borosilicate glass, and that the part of the cover adjacent the nozzles is bonded to the tops of the channel walls so as form closed channels.

A number of openings or windows 32*a*, 32*b* are formed to the rear of the cover 40 for supply of droplet liquid to respective groups of adjacent channels 42*a* and 42*b*. These openings partly define manifold chambers, one side of the manifold chamber being bounded by the open tops of the channels 22 themselves, the other side of the manifold chamber being delimited by an ink supply structure, for example the ink manifold block shown in FIG. 7 and described subsequently. These openings may be of conventional design in longitudinal section as shown in FIG. 4*a*: the opening has an upper portion 51 corresponding in size to an ink filter or ink supply conduit, for example, whilst the length of the lower portion 52 is determined, at least in part, by the length of channel to be closed by the cover. As explained with regard to FIGS. 1 and 2, the length of channel closed by the cover, known as the active length L of the channel, determines amongst other things the volume of the ejected ink drop.

The transverse section of the cover in the region of the openings is such as to permit respective groups of channels to be supplied with respective droplet liquid and yet still be separated by a single channel wall. As shown for example in FIG. 5*a*, first and second openings 32*a*, 32*b* are separated by a dividing portion 60, the lower surface of which is bonded to a single channel wall 62. The actual shape and dimensions of the dividing portion 60 will be determined by, amongst other things, the loading to which the dividing portion may be subjected, the dimensions of any ink filter or supply conduit structure, the width necessary to achieve acceptable bonding between the portion and the single channel wall, the clearance necessary to permit ink flow past the dividing portion and into the channels 63, 64 lying either side of the single channel wall 62. In the active length of the channels, i.e. that region lying between the manifold openings and the nozzle plate and denoted by "L" in FIGS. 1, 4*a* and 4*b*, the separation of the droplet liquid from one group of channels from the droplet liquid in another group of channels is ensured by the bond between the single separating channel wall and cover. As is clear from FIG. 5*b*, this bond is identical to the bonds between the other channel walls and the cover in the region of the active channels.

FIG. 6 shows detail in the bonding plane between the cover 40 and the tops of the channel walls 24 at the intersection between (a) that edge 71 of the opening 32*a* which is formed by the dividing portion 60 and attached to the single channel wall 62, and (b) that edge 72 of the opening 32*a* which runs perpendicular to the direction of extension of the channels 22 and defines one end of the active length L of the channels. The exact form of the intersection will depend on the process by which the cover and opening are manufactured (e.g. milling, ultrasonic machining, moulding), but may well be in the form of a radius, denoted R in FIG. 6. It will be appreciated that this radius will result in those channels 63, 64 bounding the single channel wall 62 being covered in part for a slightly greater length than other channels 22 in the group, resulting in these channels having a slightly greater active length. This will in turn affect the volume of the ejected ink drops, as has already been discussed above. To achieve uniformity in the ink ejecting capability of all the channels of a printhead, it is clearly necessary to control this intersection. In practice, it has been found that a radius of intersection less than or equal to two thirds of the channel width gives acceptable uniformity.

The channels 22, closed by cover 40, eject ink by way of nozzles 38 mounted at the end of the channels. These nozzles 38 are preferably formed in a nozzle plate 14 attached to the end of the channels. It is desirable that the end surfaces of the cover 40 and body 10 are coplanar so as to ensure correct seating of the nozzle plate and consequent correct alignment of the nozzles therein, which may be formed either before or after attachment of the nozzle plate to the head. In a particularly preferred embodiment, a single nozzle plate 14 covers all the channels of all the groups of channels 42*a*, 42*b* in the printhead.

Although FIGS. 3–6 illustrate by way of example a printhead having two manifolds for supply of droplet liquid, the present invention is by no means limited to such arrangement. One preferred arrangement intended for colour printing comprises four manifolds mounted side by side and supplying four adjacent groups of adjacent channels with different coloured ink (generally yellow, cyan, magenta and black) respectively. In such an arrangement, the innermost two groups of channels (firing cyan and magenta for example) will be separated on each side from another group of channels by a single active channel wall. The two outermost groups will be separated from the innermost groups by a single active channel wall, whilst at their outer extremities, these groups will be bounded by one or more guard channels, as utilised in conventional sub-heads. The four manifolds can be formed in a single sheet, the two innermost manifold chambers being separated on each side from another group of channels by a single dividing portion whilst the two outermost manifold chambers are separated from the inner chambers by single dividing portion yet bounded at their extremities by connection initially to the tops of those channel walls on either side of the guard channels and subsequently to the surface of the piezoelectric sheet in which the channels are formed. This latter arrangement is shown, for example, in WO95/04658. All four groups of channels, each firing different coloured ink, may of course be closed by a single nozzle plate as explained above.

FIG. 4*b* shows an alternative configuration for the longitudinal section of an window 32*a*, 32*b* in the cover: between the upper, inlet portion 51 of the window and that lower surface 54 of the cover which closes the channels is arranged a simple chamfer 53. Such chamfering may be restricted to the front edge 55 of the window 32*a* or, as is shown in FIG. 4*b*, the front and rear edges of the window 32*a*.

As has already been mentioned, printheads according to the present invention will generally have nozzles that are spaced in an array direction (indicated by arrow "D" in FIGS. 2 and 3). The printhead may be arranged such that the array direction extends horizontally, vertically or at an angle to the horizontal, and the array direction may furthermore extend normal or at an angle to a substrate feed direction or to a printhead scanning direction.

Further, printheads according to the present invention need not have all nozzles arranged along a single line: the printhead may comprise two banks of channels, each bank firing the same colour or colours, the nozzles of one of the banks being offset from the nozzles of the other bank by half a nozzle pitch in the nozzle array direction, thereby to obtain twice the printing resolution achievable with a single bank of channels. Alternatively, the two banks of channels may fire different coloured inks—for example one of the banks may comprise a group of nozzles firing black ink located next to a group of nozzles firing magenta ink, whilst the other bank may comprise groups of nozzles firing yellow and cyan ink respectively. Clearly, such arrangements can also be angled relative to the direction of relative movement between the substrate and the printhead, as described above.

Supply of ink to the manifold chambers may be effected by any suitable conduit/manifold system, and one embodiment of such a system is shown in FIGS. 7*a* and 7*b*. Here, the open top of each of the openings formed in the cover 40 of bonded printhead 36 is closed by a lower surface 81 of a manifold block 80, optionally with the aid of a gasket. Ink is admitted—as indicated by arrow 82—to each manifold chamber thus formed by way of multiple bores 83 and separate filter chambers 84 for each colour ink. Bores 83 may be blind bores or through bores blocked as indicated by reference 85 by grub screws. Loosening the grub screws 85 allows ink to flow from the bores 83 into a waste ink conduit 87, thereby providing a mechanism for flushing the bores 83. In the embodiment shown, manifold block 80 and printhead 36 are both bonded to a circuit board 16 to create an integrated unit. The electrodes in the printhead 36 are connected—by wire bonds for example—to conducting tracks 18 formed on the circuit board 16. Preferably, the wire bonds are protected by a conventional epoxy "potting compound" and, as shown at 88 in FIG. 3, a retainer structure—made for example of wire—may be attached to the circuit board 16, thereby creating a trough 89 to keep the liquid potting compound in place whilst it cures. The conducting tracks will in turn be connected to electrical connection means—for example a connector block (not shown)—that may be mounted either on the same side of circuit board as the printhead or on the reverse side of the circuit board to the printhead. In the latter case, electrical connection from one side of the board to the other is made by means of conducting vias.

However, the current invention is not limited to colour printhead applications: it is applicable to any arrangement where first and second groups of adjacent channels are not to be supplied directly from the same manifold. Such an arrangement may be employed when the pressure acting on the ink at either the outlet or inlet to the channels is subject to variation. This could arise, for example, when a printhead having a linear array of channels is mounted with the array direction in a non-horizontal orientation, e.g. vertically or at an angle, and supplied from a single ink supply: those channels at low elevation will be subject to a greater ink supply head which, in certain cases, may lead to the lower channels drooling ink in an uncontrolled manner. The problem can be controlled by separating the channels of the printhead into two or more groups of adjacent channels—each group being separated by a single active channel wall—and each supplied with ink held at a pressure at which all the channels of the respective group can fire without drooling. Suitable methods of pressure regulation may include separate ink reservoirs for each group of channels, the reservoirs being mounted at a uniform vertical distance relative to each channel group so as to ensure uniform supply pressure to each channel group. Alternatively the channels may be supplied from a single reservoir, with appropriately adjusted pressure regulation means arranged between the reservoir and each group of channels. Elements of both the aforementioned pressure regulation methods may be used in combination.

The covers incorporating manifold chamber structure as discussed above are amenable to manufacture on a wafer scale—as discussed in WO95/18717. Clearly a wafer of material of a given size will yield fewer covers incorporating multiple manifold structures than it would sub-head covers.

FIGS. 8 and 9 illustrate two embodiments of the invention which employ a modular conduit/manifold system 200 to supply a wide printhead 210. In FIG. 8, the wide printhead 210 comprises a number (in this case four) of printheads 220 according to the present invention and each in turn made up of a plurality (for example, two) of groups of channels. The corresponding plurality of manifold chambers for each printhead 220 are provided with ink via a supply module 230 and supply pipes 235.

The printheads 220 are mounted on a first common base member 240 to form a first assembly, whilst the driving circuitry (circuit board 250 with integrated circuits 251) for the printheads are mounted on a second common base member 260 to form a second assembly. Forming the base members of a conductive material such as aluminium aids the dissipation of generated heat. As shown at reference 270, the first and second base members 240 and 260 are joined together, following which electrical connection between the first and second assemblies can be made e.g. by wire bonding as already illustrated in FIG. 3. The base members are advantageously joined in a releasable manner such that, should either the driver assembly or the printhead assembly prove faulty in subsequent testing, it can be replaced.

The modules 230 sit atop the joined first and second assemblies such that they each seal with the ink supply windows in the covers of the respective printheads 200 (see the description relating to FIG. 7*b* in this regard). Advantageously, the front of each module is located by means of a tab 280 in a slot 290 in a retainer structure mounted on or integral with the first common base member 240, whilst the rear of the module may be secured to the second common base member 260 e.g. by means of a screw. Each printhead 200 may have its own, individual nozzle plate or, as shown in FIG. 8, a single nozzle plate may extend the entire width of the wide printhead 210. In the latter case, nozzles are preferably formed in the nozzle plate following its attachment to the printhead, thereby avoiding problems with the registration of nozzles and channels as is discussed, for example, in WO95/18717.

In the embodiment of FIG. 9, modules 231–234 feed respective groups of channels 301–304 which together make up a single printhead 220 according to the invention. In other respects, the construction of this printhead is the same as that shown in FIG. 8. It will be appreciated that the printhead component 220 in FIG. 9 is advantageously made of a single strip of piezoelectric material and as such is particularly amenable to manufacture on a wafer scale as indicated above. The printheads 220 in the embodiment of FIG. 8 can also be formed in this fashion or may each be formed from individual strips of piezoelectric material. As to the modules themselves, these will incorporate an appropriate number of bores and filter elements of the kind already discussed with respect to FIG. 7*a*. Whilst the base plate and module arrangements of FIGS. 8 and 9 have been discussed in the context of the present invention, it will be appreciated that they are equally applicable to printheads constructed according to other principles.

The present invention is not limited to the actuator designs referred to above but is applicable to any pulsed droplet deposition apparatus comprising a plurality of droplet liquid channels and channel-separating walls displaceable relative to the channel in response to actuating signals.

In a device of the kind shown in FIGS. 10*a* and 10*b* (disclosed in the aforementioned WO95/18717) having channel walls which stand proud of a base 93, the manifold structure 90 (incorporated into the cover 91 of the embodiment shown) may bond with a surface 92 of the single displaceable channel wall 62 which, in addition to lying perpendicular to the channel facing surfaces, is inclined to the plane of the channels: in such a case, the manifold/cover structure 90,91 may comprise a corresponding, possible integral, inclined dividing structure 60. Alternatively—as shown in FIGS. 11*a* and 11*b*—the dividing structure 60 may be formed by the rear portion of the single displaceable channel wall 62 which, unlike the rear portion of the other channel walls separating the channels of the respective groups, is not angled but remains square so as to sealingly engage with the manifold structure 90.

The invention is also applicable to a device of the kind disclosed in WO92/22429 (and illustrated in FIG. 12*a* in exploded form): here, channels are formed in a body 103 comprising piezoelectric material, electrodes 104 being provided on the channel walls. The channels are then closed by a cover 101 having conductive tracks 102 which are electrically connected to the electrodes 104. The front end of the channels are closed by a nozzle plate 105 whilst the rear end of the channels is closed by a manifold structure 100. As can be seen from FIG. 12*b*, the manifold structure 100 can be provided with one or more dividing portions 60 which are sealingly bonded to the rear end of respective single displaceable channel walls 62. Supply of ink into the manifold chamber may be via holes 106 in the manifold structure.

In a device of the kind disclosed in WO91/17051 and illustrated in FIG. 13*a*, the manifold chamber 110 being located underneath the channels in the body 111 of the actuator itself, the dividing portion 60 can be attached to the lower surface 113 of the single displaceable channel wall 62: the manifold structure—which will include the dividing portion 60 and which defines the manifold chambers 110—may be integral with the body 111 and the walls formed therein, as shown in FIG. 13*b*, or may be separate. The position of manifold block 112 that closes the chambers 110 and supplies ink to the chambers is indicated in dotted lines.

I claim:

1. Pulsed droplet deposition apparatus comprising a plurality of droplet liquid channels, nozzles in communication with the channels for ejection of droplets of liquid from the channels, adjacent channels being separated by a channel wall displaceable relative to said adjacent channels in response to actuating signals, a first manifold chamber from which droplet liquid is supplied to a first group of adjacent droplet liquid channels and a second manifold chamber from which droplet liquid is supplied to a second group of adjacent droplet liquid channels, wherein a single displaceable wall bounds both a channel belonging to said first group and a channel belonging to said second group.

2. Apparatus according to claim 1 wherein each manifold chamber is bounded in part by said channel walls.

3. Apparatus according to claim 2 wherein there is a seal between respective manifold chambers.

4. Apparatus according to claim 3 wherein said first and second manifold chambers are delimited at least in part by respective manifold structures, each respective structure being sealingly bonded with said single displaceable channel wall, thereby sealingly separating the first manifold chamber from the second manifold chamber.

5. Apparatus according to claim 1, wherein the respective manifold structures are integral with one another.

6. Apparatus according to claim 4 and having channels which each extend generally in a first direction, wherein the respective manifold structures are sealingly bonded with a surface of a channel wall that lies perpendicular to said first direction.

7. Apparatus according to claim 4 and having channels which each extend generally in a first direction and channel walls having channel-facing surfaces, wherein the respective manifold structures are sealingly bonded with a surface of a channel wall inclined to said first direction and perpendicular to said channel-facing surfaces.

8. Apparatus according to claim 4 and having channels which each extend generally in a first direction and channel walls having channel-facing surfaces, wherein the respective manifold structures are sealingly bonded with a surface of a channel wall lying parallel to said first direction and perpendicular to said channel-facing surfaces.

9. Apparatus according to claim 8 and where said channels comprise grooves formed in a body component, said surface of a channel wall lying at that end of the channel wall distal from the bottom of the groove.

10. Apparatus according to claim 8 and where said channels comprise grooves formed in a body component, said surface of a channel lying adjacent the bottom of the groove.

11. Apparatus according to claim 8 wherein the channels of both first and second groups of channels are closed for at least part of their length by a cover, the cover defining at least one edge of a manifold chamber.

12. Apparatus according to claim 11 wherein the cover is bonded to all channel walls.

13. Apparatus according to claim 11 wherein that side of the cover defining said at least one side of a manifold chamber is chamfered on that side of the cover bonded to at least part of each channel.

14. Apparatus according to claim 13 wherein said chamfer is at an angle of at least 45 degrees to the plane of the sheet.

15. Apparatus according to claim 11 wherein respective manifold structures are integral with the cover.

16. Apparatus according to claim 15 wherein the cover comprises a sheet of material, respective manifold chambers being at least in part formed by openings in said sheet of material.

17. Apparatus according to claim 16 wherein said opening has a first cross section at that side of the sheet remote from the channel that is smaller than a second cross section at the side of the sheet adjacent said channels.

18. Apparatus according to claim 17 wherein the cross section at the side of the sheet adjacent said channels is such that the length of the sheet remaining between the manifold chamber and the end faces of said channels that lie distant from the manifold chamber defines an active length of said channels.

19. Apparatus according to claim 17 wherein said first cross section is occupied by an ink filter.

20. Apparatus according to claim 1 wherein said channels are bounded by channel walls comprising piezoelectric material.

21. Apparatus according to claim 20 wherein said channels comprise grooves formed in a body of piezoelectric material.

22. Apparatus according to claim 20 wherein said piezoelectric material is polarised in a direction perpendicular to the plane in which the channels lie.

23. Apparatus according to claim 22 wherein said piezoelectric material is polarised in a single direction.

24. Apparatus according to claim 22 wherein said piezoelectric material is polarised in two opposing directions.

25. Apparatus according to claim 1 wherein said manifold chamber structures comprise material thermally matched to the material of the channel walls.

26. Apparatus according to claim 1 wherein said nozzles for ejection of droplet liquid are arranged in a nozzle plate bonded to that end plane of the channel walls lying distant from the manifold chamber.

27. Apparatus according to claim 26 wherein a single nozzle plate extends over all adjacent groups of channels.

28. Apparatus according to claim 20 wherein electrodes are located on opposing walls of said channels, thereby to apply an electric field to the piezoelectric material of the walls.

29. Apparatus according to claim 11 wherein those faces of said cover and said body lying distal from the manifold chamber are coplanar.

30. Apparatus according to claim 1 wherein the totality of said ink ejecting channels form an array, the two outermost ink ejecting channels of said array each being bounded by a further channel and being separated therefrom by a further displaceable channel wall.

31. Apparatus according to claim 30 wherein a respective manifold structure is bonded to the top of said further channel wall.

32. Apparatus according to claim 31 wherein said respective manifold structure is further bonded to that part of the body in which the channels are formed and which lays outside of said respective further channels in the array direction.

33. Apparatus according to claim 1 and comprising respective manifolds each supplied with different colored ink.

34. Apparatus according to claim 16 and wherein said openings in said sheet are all closed on one side of the sheet by a single manifold block having passages for supply of respective droplet fluid to respective manifold chambers.

35. Apparatus according to claim 34 wherein said manifold block contains respective ink filters in communication with each of said passages.

36. Apparatus according to claim 16 wherein the intersection between that edge of each manifold chamber defined by the cover and that surface of each manifold structure sealingly bonded with said single displaceable channel wall is such that the active length of the channel adjacent said single displaceable channel wall does not differ substantially from that of the other channels in the respective group to which said channel belongs.

37. Apparatus according to claim 36 wherein the active length of said channel adjacent said single displaceable channel wall corresponds to that of the other channels in the respective group over at least one third of its width.

38. Apparatus according to claim 36 wherein said intersection comprises a radius, said radius being no greater than two-thirds of the width of the respective channel.

39. Apparatus according to claim 1 wherein the same droplet liquid is supplied to each of the respective manifold chambers.

40. Apparatus according to claim 39 wherein the droplet liquid is supplied from a single reservoir.

41. Apparatus according claim 39 wherein respective manifold chambers are supplied with droplet liquid from respective reservoirs.

42. Apparatus according to claim 39 wherein channels in said array are located at different elevations.

43. Apparatus according to claim 39 wherein said channels are arranged in a linear array, said array being oriented at an angle to the horizontal.

44. Apparatus according to claim 43 wherein said array is oriented vertically.

45. Apparatus according to claim 39 wherein droplet liquid pressure regulation means are located in the droplet liquid flow paths from reservoir to manifold chamber.

46. Apparatus according to claim 45 wherein the pressure of said droplet liquid in said manifolds is regulated so as to be uniform in all manifolds.

47. Apparatus according to claim 11 wherein said cover comprises material thermally matched to the material of the channel walls.

* * * * *